US007585820B2

(12) United States Patent
Kleijwegt

(10) Patent No.: US 7,585,820 B2
(45) Date of Patent: Sep. 8, 2009

(54) DETERGENT COMPOSITION FOR A LOW SULFUR, LOW SULFATED ASH AND LOW PHOSPHORUS LUBRICATING OIL FOR HEAVY DUTY DIESEL ENGINES

(75) Inventor: Peter Kleijwegt, Heinenoord (NL)

(73) Assignee: Chevron Oronite Technology B.V., Rotterdam (NL)

( * ) Notice: Subject to any disclaimer, the term of this patent is extended or adjusted under 35 U.S.C. 154(b) by 390 days.

(21) Appl. No.: 11/192,583

(22) Filed: Jul. 29, 2005

(65) Prior Publication Data

US 2007/0027045 A1 Feb. 1, 2007

(51) Int. Cl.
*C10L 1/22* (2006.01)

(52) U.S. Cl. ..... 508/192

(58) Field of Classification Search ..... 508/192
See application file for complete search history.

(56) References Cited

U.S. PATENT DOCUMENTS

| | | | | |
|---|---|---|---|---|
| 5,102,566 | A | 4/1992 | Fetterman et al. | |
| 5,486,300 | A | 1/1996 | Salomon et al. | |
| 5,562,864 | A | 10/1996 | Salomon et al. | |
| 5,614,480 | A | 3/1997 | Salomon et al. | |
| 5,726,133 | A | 3/1998 | Blahey et al. | |
| 6,140,282 | A | 10/2000 | Cartwright et al. | |
| 6,159,911 | A | 12/2000 | Katafuchi | |
| 6,277,794 | B1 | 8/2001 | Dunn | |
| 6,331,510 | B1 | 12/2001 | Curtis et al. | |
| 6,569,818 | B2 | 5/2003 | Nakazato et al. | |
| 6,610,637 | B2 | 8/2003 | Curtis et al. | |
| 6,730,638 | B2 | 5/2004 | Farng et al. | |
| 6,784,143 | B2 | 8/2004 | Locke et al. | |
| 2002/0019320 | A1 * | 2/2002 | Nakazato et al. | 508/159 |
| 2003/0096716 | A1 * | 5/2003 | Locke et al. | 508/525 |
| 2003/0216266 | A1 | 11/2003 | Hirano et al. | |
| 2004/0106527 | A1 | 6/2004 | Pace et al. | |
| 2005/0026791 | A1 | 2/2005 | Esche | |

FOREIGN PATENT DOCUMENTS

| | | | |
|---|---|---|---|
| CA | 1094053 | | 1/1981 |
| EP | 0 933 417 | A1 | 8/1991 |
| EP | 1 138 753 | A2 | 10/2001 |
| EP | 1 167 497 | A2 | 1/2002 |
| EP | 1 256 619 | A1 | 11/2002 |
| WO | WO 2004/046283 | A1 | 6/2004 |

* cited by examiner

*Primary Examiner*—Walter D Griffin
*Assistant Examiner*—Frank C Campanell
(74) *Attorney, Agent, or Firm*—Sarita R. Kelley

(57) ABSTRACT

The present invention is directed to a low sulfur, low sulfated ash and low phosphorus lubricating oil composition for low emission heavy duty diesel engines comprising (a) a major amount of an oil of lubricating viscosity and (b) a detergent composition comprising a (i) a mixture of a metal salt of an alkyl hydroxyaromatic carboxylic acid and a metal salt of an alkyl phenol, and (ii) a metal salt of a Mannich condensation product of an alkyl phenol. The present invention is also directed to a low sulfur, low sulfated ash and low phosphorus lubricating oil concentrate comprising (a) an oil of lubricating viscosity and (b) a detergent composition comprising a (i) a mixture of a metal salt of an alkyl hydroxyaromatic carboxylic acid and a metal salt of an alkyl phenol, and (ii) a metal salt of a Mannich condensation product of an alkyl phenol.

49 Claims, No Drawings

DETERGENT COMPOSITION FOR A LOW SULFUR, LOW SULFATED ASH AND LOW PHOSPHORUS LUBRICATING OIL FOR HEAVY DUTY DIESEL ENGINES

FIELD OF THE INVENTION

The present invention is directed to a low sulfur, low sulfated ash and low phosphorus lubricating oil composition for low emission heavy duty diesel engines comprising (a) a major amount of an oil of lubricating viscosity and (b) a detergent composition comprising a (i) a mixture of a metal salt of an alkyl hydroxyaromatic carboxylic acid and a metal salt of an alkyl phenol, and (ii) a metal salt of a Mannich condensation product. The present invention is also directed to a low sulfur, low sulfated ash and low phosphorus lubricating oil concentrate comprising (a) an oil of lubricating viscosity and (b) a detergent composition comprising a (i) a mixture of a metal salt of an alkyl hydroxyaromatic carboxylic acid and a metal salt of an alkyl phenol, and (ii) a metal salt of a Mannich condensation product.

BACKGROUND OF THE INVENTION

Heavy duty diesel internal combustion engines mounted on motor-driven vehicles, constructions machines and power generators are generally driven using gas oil or heavy oil (which is a fuel having a sulfur content of approximately 0.05 wt. % or more). Most lubricating oils for the diesel engines have a sulfur content of approximately 0.3 to 0.7 weight percent, a sulfated ash content of approximately 1.3 to 2.0 weight percent, and a phosphorus content of approximately 0.1 to 0.13 weight percent.

In order to reduce air pollution, vehicle manufacturers and petroleum companies are interested in developing lubricating oil systems that have low emissions and better fuel economy for heavy duty diesel engines. Environmental pollution caused by emissions from diesel engines may comprise particulates and carbon oxides, sulfur oxides and nitrogen oxides. Diesel engine manufacturers have started to equip diesel engines with exhaust after-treatment devices containing particulate filters, oxidation catalysts and reduction catalysts to obviate environmental problems.

Both the fuel and the lubricating oil used to lubricate diesel engines contribute to particulates and oxides found in emissions from diesel engines. A major concern is sulfated ash derived from the salts of alkali and alkaline earth metal detergent additives in lubricating oil. The non-combustible ash deposits in diesel engines become trapped in the channels of diesel engine exhaust gas particulate filters. Conventional lubricating oils used in diesel engines are also high in sulfur content, which originates in the additive components and the base oil. Sulfur in diesel fuels is converted to sulfuric acid and sulfates which emigrate to the exhaust gas cleaning devices and directly contribute to the particulates that clog the particulate filters in heavy duty diesel engine vehicles equipped with them. Sulfuric acid may also indirectly contribute to clogging the particulate filters by wetting the particulates, thus adding to their mass. The sulfuric acid and the sulfates also poison the oxidation catalysts in the exhaust gas cleaning devices which may also result in failure to meet emission requirements. Thus, for continued functioning of these particulate traps and oxidation catalysts, it is essential that the sulfur and sulfated ash content in the lubricating oil is lowered considerably compared to the conventional diesel engine lubricating oils.

Anti-wear and anti-oxidants, such as zinc di-alkyl di-thiophosphates, also contribute to reduction in the activity of the oxidation catalysts. Increased phosphorus levels in the lubricating oil enhance deactivation of the oxidation catalysts used in exhaust gas cleaning devices. Therefore, there is a need to decrease the phosphorus content in the lubricating oil to keep the oxidation catalysts from deterioration. Furthermore, the zinc contributes to the sulfated ash which cogs the particulate filters in the exhaust gas cleaning devices.

A number of patents and patent applications have discussed methods for reducing particulate emissions and low sulfur, low sulfated ash and low phosphorus lubricating oil compositions, but none have disclosed a low emission lubricating oil of the present invention for diesel engines. Canadian Patent No. 810120 discloses a lubricating oil composition comprising the reaction product obtained by the neutralization with an alkaline earth metal oxide or hydroxide of a sulfurized alkyl phenol in admixture with a Mannich base reacted with carbon dioxide.

U.S. Pat. No. 5,102,566 discloses a low sulfated ash lubricating oil composition which comprises a base oil, at least about 2 weight percent of an ashless nitrogen- or ester-containing dispersant, an oil-soluble antioxidant material, and an oil soluble di-hydrocarbyl di-thiophosphate anti-wear material, and which has a total sulfated ash level of 0.01 to 0.6 weight percent and a weight ratio of total sulfated ash and the dispersant in the range of 0.01:1 to 0.2:2.

U.S. Pat. Nos. 5,486,300 and 5,490,945 disclose a lubricating oil composition comprising a major amount of an oil of lubricating viscosity; and (A) an amount of at least one alkali metal overbased salt of an acidic organic compound sufficient to provide at least about 0.005 equivalents of alkali metal per 100 grams of lubricating composition; (B) at least about 1.13% by weight of at least one dispersant; (C) at least one metal di-hydrocarbyl di-thiophosphate; and (D) at least one anti-oxidant, provided that the lubricating oil composition is free of calcium overbased sulfonate provided that the composition contains less than about 0.08% by weight calcium; and provided that (C) and (D) are not the same.

U.S. Pat. Nos. 5,562,864 and 5,614,480 disclose a lubricating oil composition which comprises a major amount of an oil of lubricating viscosity and (A) at least about 1% by weight of at least one carboxylic derivative composition produced by reacting (A-1) at least one substituted succinic acylating agent containing at least 50 carbon atoms in the substituent with (A-2) from about 0.5 equivalents up to about 2 moles per equivalents of acylating agent (A-1), or at least one amine compound characterized by the presence within its structure of at least one HN<group; and (B) an amount of at least one alkali metal overbased salt of a carboxylic acid or a mixture of a carboxylic acid and an organic sulfonic acid sufficient to provide at least about 0.002 equivalent of alkali metal per 100 grams of the lubricating oil composition provided that when the alkali metal salt comprises a mixture of overbased alkali metal salts of hydrocarbyl-substituted carboxylic acids and a hydrocarbyl-substituted sulfonic acid, then the carboxylic acid comprises more than 50% of the acid equivalents of the mixture; and either; (C-1) at least one magnesium overbased salt of an acidic organic compound provided that the lubricating oil composition is free of calcium overbased salts of acidic organic compounds; or (C-2) at least one calcium overbased salt of an acidic organic compounds provided that the lubricating composition is free of magnesium overbased salts of acidic organic compounds.

U.S. Pat. No. 5,726,133 discloses a low ash natural gas engine oil which contains an additive package including a particular combination of detergents and also containing other standard additives such as dispersants, anti-oxidants, anti-wear agents, metal deactivators, anti-foamants and pour point depressants and viscosity index improvers. The low ash natural gas engine oil exhibits reduced deposit formation and enhanced resistance to oil oxidation and nitration.

U.S. Pat. No. 6,140,282 discloses a long life lubricating oil as evidenced by a reduction in viscosity increase, oxidation and nitration, comprising a major amount of a base oil of lubricating viscosity and a minor amount of a mixture of high TBN, medium TBN and low/neutral TBN detergents which in the metal salicylate detergents is at least one of the medium or low/neutral TBN detergents.

U.S. Pat. No. 6,159,911 discloses a diesel engine oil composition containing a lube oil base and one or more metallic detergents-dispersants selected from among a perbasic alkaline earth metal sulfonate, phenolate and salicylate. The total phosphorus content of the composition is suppressed to 100 parts per million by weight or less, to thereby provide diesel engine oil compositions having oxidation stability and wear resistance.

U.S. Pat. No. 6,162,770 discloses an un-sulfurized, alkali metal-free, detergent-dispersant composition having from about 40% to 60% alkylphenol, from 10% to 40% alkaline earth alkylphenol, and from 20% to 40% alkaline earth single aromatic-ring alkylsalicylate. This composition may have an alkaline earth double aromatic-ring salicylates as long as the mole ratio of single-ring alkylsalicylate to double aromatic ring alkylsalicylate is at least 8:1.

U.S. Pat. No. 6,277,794 discloses a marine diesel lubricant composition having a TBN of at least 10 and preferably a VI of at least 90, comprise a major amount of oil of lubricating viscosity, and admixed therewith, minor amounts of an ashless anti-wear additive and a metal detergent in the form of (i) an overbased metal detergent having a TBN of at least 300, more preferably at least 400, and comprising a surfactant system derived from at least two surfactants, and/or (ii) a metal detergent other than (i); provided that, if detergent (ii) is present, the composition does not contain a minor amount of an extreme pressure additive, being up to 5.0 mass percent on the total mass of the composition.

U.S. Pat. Nos. 6,331,510 and 6,610,637 disclose a lubricant containing (a) a synthetic base oil composition having an overall kinematic viscosity of at least about $4.8\times10^{-6}$ $m^2/s$ (4.8 cSt) at 100° C. and a viscosity index of at least 110; (b) a dispersant-viscosity modifier; and (c) a sulfur-free functionalized hydrocarbyl-substituted phenol detergent provides improved valve train wear, with longer drain intervals, to heavy duty diesel engines.

U.S. Pat. No. 6,569,818 discloses a lubricating oil composition having a low phosphorus content of 0.01 to 0.1 weight percent, and a sulfated ash of 0.1 to 1.0 weight percent, which is composed of a (a) major amount of mineral base oil having a low sulfur content of at most 0.1 weight percent; (b) an ashless alkenyl or alkyl-succinimide dispersant; (c) a metal-containing detergent (non-sulfurized alkali metal or alkaline earth metal salt of an alkylsalicylic acid and/or non-sulfurized alkali metal or alkaline earth metal salt of an alkyl phenol having a Mannich base structure; (d) zinc di-alkyl di-thiophosphate; (e) an oxidation inhibitor (phenol compound and/or amine compound) and wherein the sulfur content is 0.01 to 0.3 weight percent. The lubricating oil composition shows good high temperature detergency notwithstanding its low sulfur, phosphorus and sulfated ash content, and is favorably employable in diesel engines using fuel of a low sulfur content.

U.S. Pat. No. 6,730,638 discloses a lubricating oil for internal combustion engines especially useful with fuels having less than 350 parts per million sulfur comprises a lubricating oil basestock, a boron containing ashless dispersant, a molybdenum containing friction reduction agent, a metal type detergent and zinc di-thiophosphate.

U.S. Pat. No. 6,784,143 discloses the use of a minor amount of a detergent composition comprising one or more metal detergents which comprises metal salts of organic acids, wherein the detergent composition comprises more than 50 mole percent, based on the moles of the metal salts of organic acids in the detergent composition, of: (I) a metal salt of an aromatic carboxylic acid, or (II) a metal salt of a phenol, or (III) both a metal salt of an aromatic carboxylic acid and a metal salt of a phenol, in a lubricating oil composition for improving oxidation resistance of the lubricating oil composition, wherein the amount of phosphorus and sulfur in the oil composition is less than 0.09 mass % and at the most 0.5 mass % respectively, based on the mass of the oil composition. It has also been found that a detergent composition comprising more than 50 mole % of a metal salt of an aromatic carboxylic acid improves the reduction in wear in an engine.

European Patent Application No. 01201752.1 (Publication No. EP 1 256 619 A1) deemed withdrawn as of Mar. 5, 2005, and U.S. patent application Ser. No. 10/142,513 (Publication No. US 2003/0096716 A1) disclose a lubricating oil composition comprising: (A) an oil of lubricating viscosity, in a major amount and added thereto: (B) a detergent composition comprising one or more metal detergents which comprises metal salts or organic acids, in a minor amount, wherein the detergent composition comprises more than 50 mole percent of a metal salt of an aromatic carboxylic acid, based on the moles of the metal salts of organic acids in the detergent composition, and (C) one or more co-additives, in a minor amount; wherein the total amounts of phosphorus and sulfur derived from (B) or (C) or both (B) and (C) are less than 0.1 mass p % of phosphorus and at the most 0.5 mass % of sulfur, based on the mass of the oil composition. It has been found that a detergent composition comprising more than 50 mole % of a metal salt of an aromatic carboxylic acid improves the reduction in wear in an engine.

U.S. patent application Ser. No. 10/430,594 (Publication No. US 2003/0216266 A1) discloses a lubricating oil composition employable in combination with a low sulfur content fuel oil is preferably composed of a base oil having a sulfur content of at most 0.2 weight percent, an ashless dispersant comprising an alkenyl- or alkyl-succinimide or derivative thereof, a metal-containing detergent containing an organic acid metal salt, a zinc di-alkyl di-thiophosphate, a zinc di-alkylaryl di-thiophosphate, and an oxidation inhibitor selected from a group consisting of a phenol compound, an amine compound, and a molybdenum-containing compound, wherein a ratio of the phosphorus content of the zinc di-alkyl di-thiophosphate to the phosphorus content of the zinc di-alkylaryl di-thiophosphate is in the range of 20:1 to 2:1.

U.S. patent application Ser. No. 10/344,390 (Publication No. US 2004/0106527 A1) discloses a lubricating oil composition used in conjunction with a gasoline fuel having a sulfur content of less than 10 parts per million by weight, characterized in that said oil composition has a phosphorus content of no more than 0.05 percent by weight.

International Publication No. WO 2004/046283 A1 discloses the use of lubricating oils with low sulfur content in combination with a low sulfur fuel to reduce particulate emissions of a diesel engine equipped with a particulate trap.

U.S. patent application Ser. No. 10/630,026 (Publication No. US 2005/0026791 A1) discloses a low sulfur, low ash, and low phosphorus lubricant additive package comprising at one amine salt of a di-alkyl mono-thiophosphate. Further, the patent application discloses lubricating oils based on the lubricant additive package and methods of use.

SUMMARY OF THE INVENTION

The present invention is directed to a low sulfur, low sulfated ash and low phosphorus lubricating oil composition for low emission heavy duty diesel engines comprising (a) a major amount of an oil of lubricating viscosity and (b) a detergent composition comprising (i) a mixture of a metal salt of an alkyl hydroxyaromatic carboxylic acid and a metal salt of an alkyl phenol, and (ii) a metal salt of a Mannich condensation product. The present invention is also directed to a low sulfur, low sulfated ash and low phosphorus lubricating oil concentrate comprising (a) an oil of lubricating viscosity and (b) a detergent composition comprising (i) a mixture of a metal salt of an alkyl hydroxyaromatic carboxylic acid and a metal salt of an alkyl phenol, and (ii) a metal salt of a Mannich condensation product.

Specifically, the present invention is directed a low sulfur, low sulfated ash and low phosphorus lubricating oil composition for low emission heavy duty diesel engines comprising comprising:

(a) a major amount of an oil of lubricating viscosity;

(b) a detergent composition comprising (i) a mixture of a metal salt of an alkyl hydroxyaromatic carboxylic acid and a metal salt of an alkyl phenol, and (ii) a metal salt of a Mannich condensation product.

In (b) in the above lubricating oil composition, preferably the ratio of (i) the mixture of a metal salt of an alkyl hydroxyaromatic carboxylic acid and a metal salt of an alkyl phenol to (ii) the metal salt of a Mannich condensation product is in the range of about 80:20 weight percent to about 20:80 weight percent based on the total weight of the detergent composition. Preferably the ratio of (i) the mixture of a metal salt of an alkyl hydroxyaromatic carboxylic acid and a metal salt of an alkyl phenol to (ii) the metal salt of a Mannich condensation product is in the range of about 70:30 weight percent to about 30:70 weight percent based on the total weight of the lubricating oil composition. More preferably the ratio of (i) the mixture of a metal salt of an alkyl hydroxyaromatic carboxylic acid and a metal salt of an alkyl phenol to (ii) the metal salt of a Mannich condensation product is about 50:50 weight percent based on the total weight of the lubricating oil composition.

In the mixture in (i) in the detergent composition of the above lubricating oil composition the ratio of the metal salt of an alkyl hydroxyaromatic carboxylic acid to the metal salt of an alkyl phenol is in the range of about 80:20 weight percent to about 20:80 weight percent based on the total weight of (i). More preferably the ratio of the metal salt of an alkyl hydroxyaromatic carboxylic acid to the metal salt of an alkyl phenol is in the range of about 60:40 weight percent to about 40:60 weight percent based on the total weight of (i). Most preferably the ratio of the metal salt of an alkyl hydroxyaromatic carboxylic acid and the metal salt of an alkyl phenol is about 50:50 weight percent based on the total weight of (i).

The alkyl group on the alkyl hydroxyaromatic carboxylic acid in (i) in the detergent composition of the above lubricating oil composition is a linear chain or a branched chain alkyl group or mixtures thereof. Preferably the alkyl group on the alkyl hydroxyaromatic carboxylic acid is a mixture of linear chain and branched chain alkyl groups. More preferably the ratio of the linear chain alkyl groups to the branched chain alkyl group in the mixture is in the range of about 70:30 to about 30:70 based on the total alkyl groups on the alkyl hydroxyaromatic carboxylic acid. Most preferably the ratio of the linear chain alkyl groups to the branched chain alkyl group in the mixture is about 50:50 based on the total alkyl groups on the alkyl hydroxyaromatic carboxylic acid.

The alkyl group on the alkyl phenol in (i) in the detergent composition of the above lubricating oil composition is a linear chain or a branched chain alkyl group. Preferably the alkyl group on the alkyl phenol is a mixture of linear chain and branched chain alkyl groups or mixtures thereof. More preferably the ratio of the linear chain alkyl groups to the branched chain alkyl group in the mixture is in the range of about 70:30 to about 30:70 based on the total alkyl groups on the alkyl phenol. Most preferably the ratio of the linear chain alkyl groups to the branched chain alkyl group in the mixture is about 50:50 based on the total alkyl groups on the alkyl phenol.

Preferably the branched chain alkyl group on the alkyl hydroxyaromatic carboxylic acid in (i) in the detergent composition of the above lubricating oil composition has from about 4 carbon atoms to about 60 carbon atoms. More preferably the branched chain alkyl group on the alkyl hydroxyaromatic carboxylic acid has from about 6 carbon atoms to about 40 carbon atoms. Most preferably the branched chain alkyl group on the alkyl hydroxyaromatic carboxylic acid has from about 8 carbon atoms to about 20 carbon atoms.

Preferably the linear chain alkyl group on the alkyl hydroxyaromatic carboxylic acid in (i) in the detergent composition of the above lubricating oil composition has from about 4 carbon atoms to about 60 carbon atoms. More preferably the linear chain alkyl group on the alkyl hydroxyaromatic carboxylic acid has from about 12 carbon atoms to about 40 carbon atoms. Most preferably the alkyl group on the alkyl hydroxyaromatic carboxylic acid has from about 20 carbon atoms to about 30 carbon atoms.

Preferably the branched chain alkyl group on the alkyl phenol in (i) in the detergent composition of the above lubricating oil composition has from about 4 carbon atoms to about 60 carbon atoms. More preferably the branched chain alkyl group on the alkyl phenol has from about 6 carbon atoms to about 40 carbon atoms. Most preferably the branched chain alkyl group on the alkyl phenol has from about 8 carbon atoms to about 20 carbon atoms.

Preferably the linear chain alkyl group on the alkyl phenol in (i) in the detergent composition of the above lubricating oil composition has from about 4 carbon atoms to about 60 carbon atoms. More preferably the linear chain alkyl group on the alkyl phenol has from about 12 carbon atoms to about 40 carbon atoms. Most preferably the linear chain alkyl group on the alkyl phenol has from about 20 carbon atoms to about 30 carbon atoms.

The Mannich condensation product in (ii) in the detergent composition in the lubricating oil of the present invention is prepared from a formaldehyde or an aldehyde having one carbon atom to about 20 carbon atoms, a nitrogen base selected from ammonia, a lower alkyl amine, a polyamine and mixtures thereof, and an alkyl phenol.

Preferably the alkyl group on the alkyl phenol employed to prepare the Mannich condensation product in (ii) in the detergent composition of the present invention is a linear chain or a branched chain alkyl group or mixtures thereof. Preferably the alkyl group on the alkyl phenol employed to prepare the Mannich condensation product is a branched chain alkyl group.

Preferably the branched chain alkyl group on the alkyl phenol employed to prepare the Mannich condensation product in (ii) in the detergent composition of the present invention has from about 4 carbon atoms to about 60 carbon atoms.

Most preferably the branched chain alkyl group on the alkyl phenol has from about 6 carbon atoms to about 40 carbon atoms. Most preferably the branched chain alkyl group on the alkyl phenol has from about 8 carbon atoms to about 20 carbon atoms.

Preferably the linear chain alkyl group on the alkyl phenol employed to prepare the Mannich condensation product in (ii) in the detergent composition of the present invention has from about 4 carbon atoms to about 60 carbon atoms. Most preferably the linear chain alkyl group on the alkyl phenol has from about 12 carbon atoms to about 40 carbon atoms. Most preferably the branched chain alkyl group on the alkyl phenol has from about 20 carbon atoms to about 30 carbon atoms.

In a preferred embodiment of the lubricating oil composition of the present invention, in (i) the alkyl hydroxyaromatic carboxylic acid is an alkyl hydroxybenzene carboxylic acid, wherein the alkyl group is a 50:50 mixture of a branched chain $C_{12}$ alkyl group and a linear chain $C_{20}$ to $C_{30}$ alkyl group. The alkyl group on the alkyl phenol in (i) is a 50:50 mixture of branched chain $C_{12}$ alkyl group and linear chain $C_{20}$ to $C_{30}$ alkyl group. In (ii) the Mannich condensation product is a condensation product of an alkyl phenol, wherein the alkyl group is a branched chain $C_{12}$ alkyl group, paraformaldehyde and mono-methyl amine.

The metal in the metal salt of an alkyl hydroxyaromatic carboxylic acid and the metal salt of an alkyl phenol independently may be an alkali metal or an alkaline earth metal. Preferably the metal is an alkaline earth metal. More preferably the alkaline earth metal is calcium.

The metal in the metal salt of a Mannich condensation product may be an alkali metal or an alkaline earth metal. Preferably the metal is an alkaline earth metal, and more preferably the alkaline earth metal is Calcium.

Preferably the sulfur content of the lubricating oil composition of the present invention is in the range of 0.0 weight percent to about 0.4 weight percent based on the total weight of the lubricating oil. More preferably the sulfur content of the lubricating oil composition of the present invention is in the range of 0.05 weight percent to about 0.3 weight percent based on the total weight of the lubricating oil. Most preferably the sulfur content of the lubricating oil composition of the present invention is in the range of 0.1 weight percent to about 0.2 weight percent based on the total weight of the lubricating oil.

Preferably the sulfated ash content of the lubricating oil composition of the present invention is in the range of 0.2 weight percent to about 4.0 weight percent based on the total weight of the lubricating oil. More preferably the sulfated ash content of the lubricating oil composition of the present invention is in the range of 0.5 weight percent to about 2.0 weight percent based on the total weight of the lubricating oil. Most preferably the sulfated ash content of the lubricating oil composition of the present invention is in the range of 0.75 weight percent to about 1.2 weight percent based on the total weight of the lubricating oil.

Preferably the phosphorus content of the lubricating oil composition of the present invention is in the range of 0.005 weight percent to about 0.06 weight percent based on the total weight of the lubricating oil. More preferably the phosphorus content of the lubricating oil composition of the present invention is in the range of 0.015 weight percent to about 0.05 weight percent based on the total weight of the lubricating oil. Most preferably the phosphorus content of the lubricating oil composition of the present invention is in the range of 0.03 weight percent to about 0.04 weight percent based on the total weight of the lubricating oil.

The above lubricating oil composition further comprises one or more lubricating oil additives selected from dispersants, anti-oxidants, viscosity index improvers, corrosion inhibitors, anti-wear agents, friction modifiers, pour point depressants and foam inhibitors.

Preferably the above lubricating oil composition further comprises one or more dispersants. More preferably the dispersants are ashless dispersants. Most preferably the ashless dispersants are derivatives of succinic anhydride.

The lubricating oil composition of the present invention may also contain viscosity index improvers such as polyalkyl methacrylates, ethylene-propylene copolymers, styrene-butadiene copolymers and polyisoprene.

Corrosion inhibitors and anti-oxidants optionally contemplated for use in the lubricating oil of the present invention are metal di-alkyl di-thiophosphates and derivatives of di-phenyl amine.

Metal di-alkyl di-thiophosphates may also be included in the lubricating oil composition of the present invention to provide anti-wear. However, it may be advantageous to control the amount of this additive because of its metal and phosphorus contribution to the lubricating oil. Examples of metal di-alkyl di-thiophosphates are zinc and molybdenum salts of di-alkyl di-thiophosphates.

Typically, friction modifiers are used to impart the proper friction characteristics to the lubricating oil composition. Useful friction modifiers are fatty acid esters and amides and molybdenum compounds, such as amine-molybdenum complex compound and molybdenum di-thiocarbamates. However, it should be noted that the addition of molybdenum di-thiocarbamates will further contribute sulfur to the lubricating oil composition.

Pour point depressants lower the temperature at which the fluid will flow or can be poured. Additives that optimize the low temperature fluidity of the lubricating oil are various copolymers, such as polymethacrylates.

Useful foam inhibitors are of the polysiloxane type.

A further embodiment of the present invention is directed to a low sulfur, low sulfated ash and low phosphorus lubricating oil concentrate for low emission heavy duty diesel engines comprising:

(a) a major amount of an oil of lubricating viscosity;

(b) a detergent composition comprising (i) a mixture of a metal salt of an alkyl hydroxyaromatic carboxylic acid and a metal salt of an alkyl phenol, and (ii) a metal salt of a Mannich condensation product.

Another embodiment of the present invention is directed to a method for lubricating low emission heavy duty diesel engines using a low sulfur, low sulfated ash and low phosphorus lubricating oil composition comprising:

(a) a major amount of an oil of lubricating viscosity;

(b) a detergent composition comprising (i) a mixture of a metal salt of an alkyl hydroxyaromatic carboxylic acid and a metal salt of an alkyl phenol, and (ii) a metal salt of a Mannich condensation product.

An additional embodiment of the invention is directed to the use of a low sulfur, low sulfated ash and low phosphorus lubricating oil composition for lubricating low emission heavy duty diesel engines comprising:

(c) a major amount of an oil of lubricating viscosity;

(d) a detergent composition comprising (i) a mixture of a metal salt of an alkyl hydroxyaromatic carboxylic acid and a metal salt of an alkyl phenol, and (ii) a metal salt of a Mannich condensation product.

DETAILED DISCRIPTION OF THE INVENTION

Definitions

As used herein, the following terms have the following meanings unless expressly stated to the contrary:

The term "aldehydes" as used herein refer to formaldehyde or aldehydes having the formula

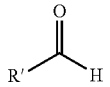

wherein R' is branched or linear alkyl having from one carbon atom to about 10 carbon atoms, cycloalkyl having from about 3 carbon atoms to about 10 carbon atoms, aryl having from about 6 carbon atoms to about 10 carbon atoms, alkaryl having from about 7 carbon atoms to about 20 carbon atoms, or aralkyl having from about 7 carbon atoms to about 20 carbon atoms.

Aldehydes most preferred for use in the in the preparation of the Mannich condensation products of the present invention are paraformaldehyde and formalin.

The term "alkali metal" as used herein refers to Group I metals of the Periodic Table, such as sodium, potassium and lithium.

The term "alkaline earth metal" as used herein refers to Group II metals of the Periodic Table, such as calcium and magnesium.

The term "a nitrogen base" as used herein refers to a nitrogen base selected from ammonia, a lower alkyl amine, having one carbon atom to about 10 carbon atoms, a polyamine having 2 amine nitrogen atoms to 12 amine nitrogen atoms and 2 carbon atoms to about 40 carbon atoms, and mixtures thereof.

The term "detergents" as used herein refers to additives designed to hold the acid-neutralizing compounds in solution in the oil. They are usually alkaline and react with the strong acids (sulfuric and nitric) which form during the combustion of the fuel and which would cause corrosion to the engine parts if left unchecked. Suitable detergents for use in the present invention are alkyl sulfonates, alkyl phenates and Mannich base condensation products. Numerous detergents are commercially readily available.

The term "dispersants" as used herein refers to additives that keep soot and combustion products in suspension in the body of the oil charge and therefore prevent deposition as sludge or lacquer. Typically, the ashless dispersants are nitrogen-containing dispersants formed by reacting alkenyl succinic acid anhydride with an amine. Examples of such dispersants are alkenyl succinimides and succinamides. These dispersants can be further modified by reaction with, for example, boron or ethylene carbonate. Ester-based ashless dispersants derived from long chain hydrocarbon-substituted carboxylic acids and hydroxy compounds may also be employed. Preferred ashless dispersants are those derived from polyisobutenyl succinic anhydride. A large number of dispersants are commercially available.

The term "low sulfur" as used herein refers to the sulfur content of the lubricating oil composition of the present invention. The sulfur content is in the range of 0.0 weight percent to about 0.4 weight percent based on the total weight of the lubricating oil composition.

The term "low phosphorus" as used herein refers to the phosphorus content of the lubricating oil composition of the present invention. The phosphorus content is in the range of about 0.005 weight percent to about 0.06 weight percent based on the total weight of the lubricating oil composition.

The term "low sulfated ash" as used herein refers to the sulfated ash content of the lubricating oil composition of the present invention. The sulfated ash content is in the range of about 0.2 weight percent to about 4.0 weight percent based on the total weight of the lubricating oil composition.

The term "Mannich condensation product" as used herein refers to the condensation product of an alkyl phenol, a formaldehyde or an aldehyde having one carbon atom to about 20 carbon atoms and a nitrogen base selected from ammonia, a lower alkyl amine having one carbon atom to about 10 carbon atoms, a polyamine having 2 amine nitrogen atoms to about 12 amine nitrogen atoms and 2 carbon atoms to about 40 carbon atoms, and mixtures thereof.

The term "overbased" as used herein refers to alkaline earth metal alkyl phenols, alkyl salicylates and alkyl sulfonates in which the ratio of the number of equivalents of an alkaline earth metal to the number of equivalents of the organic moiety is greater than 1. Low overbased refers to alkaline earth metal alkyl phenols, alkyl salicylates and alkyl sulfonates having a Total Base Number (TBN) greater than 1 and less than 20, medium overbased refers to alkaline earth metal alkyl phenols, alkyl salicylates and alkyl sulfonates having a TBN greater than 20 and less than 200. High overbased refers to alkaline earth metal alkyl phenols, alkyl salicylates and alkyl sulfonates having a TBN greater than 200.

The term "sulfated ash" as used herein refers to the non-combustible residue resulting from detergents and metallic additives in lubricating oil. Sulfated ash was determined using ASTM Test D874.

The term "Total Base Number" or "TBN" as used herein refers to the amount of base equivalent to milligrams of KOH in one gram of sample. Thus, higher TBN numbers reflect more alkaline products, and therefore a greater alkalinity. TBN was determined using the test ASTM D 2896.

Unless otherwise specified, all percentages are in weight percent.

Lubricating Oil Composition

It has been discovered that the detergent composition comprising (i) a mixture of a metal salt of an alkyl hydroxyaromatic carboxylic acid and a metal salt of an alkyl phenol, and (ii) a metal salt of a Mannich condensation product in the low sulfur, low sulfated ash and low phosphorus lubricating oil composition of the present invention provides good detergency and deposit control when used for low emission heavy duty diesel engines. The present invention is also directed to a low sulfur, low sulfated ash and low phosphorus lubricating oil concentrate comprising (a) a major amount of an oil of lubricating viscosity and (b) a detergent composition. Thus, even though the lubricating oil composition of the present invention has low sulfur contents, the detergent composition, which is also low in sulfur content, maintains the functionality and quality of the lubricating oil composition.

The low sulfur, low sulfated ash and low phosphorus lubricating oil composition of the present invention comprises a major amount of an oil of lubricating viscosity and a detergent composition comprising (i) a mixture of a metal salt of an alkyl hydroxyaromatic carboxylic acid and a metal salt of an alkyl phenol, and (ii) a metal salt of a Mannich condensation product. The lubricating oil composition of the present invention may be prepared by simple blending or mixing of the compounds described in more detail below. These compounds may also be preblended as a concentrate or package with various other additives in appropriate ratios to facilitate blending of a lubricating oil composition containing the desired concentration of additives.

Oil of Lubricating Viscosity

Oil of lubricating viscosity, or base oil as used herein refer to lubricating oils which may be mineral oil or synthetic oils of lubricating viscosity and preferably useful in the crankcase of an internal combustion engine. Crankcase lubricating oils ordinarily have a viscosity of about 1300 centistokes at −17.8° C. to 22.7 centistokes at 98.9° C. The lubricating oils may be derived from synthetic or natural sources. Mineral oil for use as the base oil in this invention includes paraffinic, naphthenic and other oils that are ordinarily used in lubricating oil compositions. Synthetic oils include hydrocarbon synthetic oils and synthetic esters. Useful synthetic hydrocarbon oils include liquid polymers of alpha-olefins having the proper viscosity. Especially useful are the hydrogenated liquid oligomers of $C_6$ to $C_{12}$ alpha-olefins such as 1-decene trimer. Similarly, alkyl benzenes of proper viscosity, such as didodecyl benzene, may be used. Useful synthetic esters include the esters of both mono-carboxylic acids and polycarboxylic acids as well as mono-hydroxy alkanols and polyols. Typical examples are didodecyl adipate, pentaerthritol tetracapoate, di-2-ethylhexyl adipate, di-laurylsebacate and the like. Complex esters prepared from mixtures of mono- and di-carboxylic acid and mono- and di-hydroxy alkanols can also be used. Blends of hydrocarbon oils and synthetic oils may also be used. For example, blends of 10 weight percent to 25 weight percent hydrogenated 1-decene trimer with 75 weight percent to 90 weight percent 683 centistokes at 37.8° C. mineral oil gives an excellent oil base. Fischer-Tropsch derived base oils may also be employed in the lubricating oil composition of the present invention.

It is further contemplated that the oil of lubricating viscosity employed for preparing the lubricating oil composition of the present invention is a low sulfur base oil. Use of a low sulfur base oil will assist in obtaining a lubricating oil composition which is ultra low in sulfur content. Sulfur content of base oils is well known to persons skilled in the art, thus, selection of a low sulfur base oil may be conveniently made for the purpose of the present invention.

Detergents

Detergents are used in lubricating oil to neutralize acid oxidation products, such as sulfuric acid in the case of diesel fuel, and to control deposits. Detergents conventionally used in heavy duty diesel lubricating oil compositions are low, medium and high metal overbased sulfurized, and/or carbonated alkyl phenols or metal overbased sulfonates. However, lubricating oil compositions containing these detergents are high in sulfur and metal content, 0.3 weight percent and 0.6 weight percent, respectively. On combustion, these lubricating oils may yield 1.3 weight percent sulfated ash, which leads to the formation of particulate matter with the resultant plugging and malfunctioning of the exhaust gas after-treatment system and increased emissions. The detergent composition of the present invention was discovered in response to the need to find a detergent composition without the high sulfur and metal content of conventional detergent compositions, while maintaining good detergency.

Detergents used in the detergent composition of the low sulfur, low sulfated ash and low phosphorus lubricating oil composition of the present invention do not contain high metal overbased sulfurized, and/or carbonated alkyl phenols or metal overbased sulfonates. Although, small amounts of low and/or medium overbased detergents may be included in the detergent composition of the present invention, detergents mainly employed are (i) a mixture of a metal salt of an alkyl hydroxyaromatic carboxylic acid and a metal salt of an alkyl phenol, and (ii) a metal salt of a Mannich condensation product.

Metal Salts of the Alkyl Hydroxyaromatic Carboxylic Acids

Alkyl hydroxyaromatic carboxylic acids used for preparing the metal salts may be single ring, double ring or fused ring alkyl hydroxyaromatic carboxylic acids. Preferably the alkyl hydroxyaromatic carboxylic acids are single ring alkyl hydroxyaromatic carboxylic acids, more preferably the alkyl hydroxyaromatic carboxylic acids are alkyl hydroxybenzene carboxylic acids, wherein the alkyl group may be a branched chain alkyl group containing from about 4 carbon atoms to about 60 carbon atoms or linear chain alkyl group containing 4 carbon atoms to 60 carbon atoms, or mixtures thereof. Most preferably the alkyl group on the alkyl hydroxybenzene is a 50:50 weight percent mixture of branched chain alkyl group containing about 8 carbon atoms to about 20 carbon atoms and linear chain alkyl group containing from about 20 carbon atoms to about 30 carbon atoms. Preferably the branched chain alkyl group and the linear chain alkyl group is independently attached to the hydroxybenzene in a position para or ortho to the hydroxyl group on the hydroxybenzene moiety.

More preferably the ratio of the attachment of the linear chain alkyl group in the ortho-position to para-position is 70:30 based on the total alkyl hydroxybenzene and most preferably the ratio of the attachment of the linear chain alkyl group in the ortho-position to hydroxy-position is 60:40 based on the total alkyl hydroxybenzene. More preferably the ratio of the attachment of the branched chain alkyl group in the ortho-position to para-position is 20:80 based on the total alkyl hydroxybenzene, and most preferably the ratio of the attachment of the branched chain alkyl group in the ortho-position to para-position is 5:95 based on the total alkyl hydroxybenzene.

The carboxylic acid moiety on the alkyl hydroxyaromatic carboxylic acid may be attached directly or indirectly to the hydroxybenzene. Preferably carboxylic acid moiety is attached directly to the alkyl hydroxyaromatic moiety.

The metal employed to make the salts of the alkyl hydroxyaromatic carboxylic acid may be an alkali metal or an alkaline earth metal. Preferably the metal is an alkaline earth metal and more preferably the metal is calcium.

The method for preparation of the metal salts of alkyl hydroxyaromatic carboxylic acids are well known in the art. Generally, the alkyl hydroxyaromatic carboxylic acids are prepared by carboxylation of the corresponding alkyl hydroxyaromatic compounds using carbon dioxide. The metal salts are prepared using the oxides, hydroxide or alkoxides of the desired metal. For example, the alkyl hydroxyaromatic carboxylic acids may be prepared as described in U.S. Pat. No. 6,162,770.

Metal Salt of an Alkyl Phenol

The alkyl group on the alkyl phenol may be a branched chain alkyl group containing from about 4 carbon atoms to about 60 carbon atoms or linear chain alkyl group containing 6 carbon atoms to 60 carbon atoms, or mixtures thereof. More preferably the alkyl group on the alkyl phenol is a 50:50 weight percent mixture of branched chain alkyl group containing about 8 carbon atoms to about 20 carbon atoms and linear chain alkyl group containing from about 20 carbon atoms to about 30 carbon atoms. The linear chain alkyl group and the branched chain alkyl group is independently attached to the hydroxybenzene in a position ortho or para to the hydroxyl group on the benzene moiety.

More preferably the ratio of the attachment of the linear chain alkyl group in the ortho-position to para-position is 70:30 based on the total alkyl hydroxybenzene and most preferably the ratio of the attachment of the linear chain alkyl group in the ortho-position to para-position is 60:40 based on the total alkyl hydroxybenzene. More preferably the ratio of the attachment of the branched chain alkyl group in the ortho-position to para-position is 20:80 based on the total alkyl hydroxybenzene and most preferably the ratio of the attachment of the branched chain alkyl group in the ortho-position to para-position is 5:95 based on the total alkyl hydroxybenzene.

The metal employed to make the salts of the alkyl phenol may be an alkali metal or an alkaline earth metal. Preferably the metal is an alkaline earth metal and more preferably the metal is calcium.

The method for preparation of the metal salts of alkyl phenols are well known in the art. Typically, the metal salt of the alkyl phenol is prepared by first alkylating the phenol and then preparing the metal salt using the oxides, hydroxide or the alkoxides of the desired metal, for example as described in U.S. Pat. No. 5,292,968.

Alternately, the metal salts of the alkyl hydroxyaromatic carboxylic acid and the alkyl phenol may be prepared by making the desired mixture of the alkyl hydroxyaromatic carboxylic acid and the alkyl phenol and subsequently making the metal salts using the desired metal oxides, hydroxides or the alkoxides.

Metal Salt of Mannich Condensation Product

The Mannich condensation product employed in the detergent composition of the present invention may be prepared using an alkyl phenol, a formaldehyde or an aldehyde and a nitrogen base selected from ammonia, a lower alkyl amine, a polyamine and mixtures thereof.

The alkyl group on the alkyl phenol used for the preparation of the Mannich condensation product may be a branched chain alkyl group, a linear chain alkyl group or mixtures thereof. Preferably the alkyl group is a branched chain alkyl group containing from about 4 carbon atoms to about 60 carbon atoms. More preferably 6 carbon atoms to about 40 carbon atoms and most preferably from about 8 carbon atoms to about 20 carbon atoms.

Preferably the linear chain alkyl group contains from about 4 carbon atoms to about 60 carbon atoms. More preferably the linear chain alkyl group contains from about 12 carbon atoms to about 40 carbon atoms and most preferably the linear chain alkyl group contains from about 20 carbon atoms to about 30 carbon atoms.

The alkyl group is attached to the phenol moiety at the position ortho or para to the hydroxyl group.

More preferably the ratio of the attachment of the branched chain alkyl group in the ortho-position to para-position is 20:80 based on the total alkyl phenol, and most preferably the ratio of the attachment of the branched chain alkyl group in the ortho-position to para-position is 5:95 based on the total alkyl phenol.

Preferably the ratio of the attachment of the linear chain alkyl group in the ortho-position to para-position is 70:30 based on the total alkyl hydroxybenzene and most preferably the ratio of the attachment of the linear chain alkyl group in the ortho-position to hydroxy-position is 60:40 based on the total alkyl hydroxybenzene.

The aldehyde useful for the preparation of the Mannich condensation product may be a formaldehyde or an aldehyde having one carbon atom to about 20 carbon atoms. Preferably the formaldehyde or the aldehyde is an aldehyde, and more preferably it is paraformaldehyde.

The nitrogen base is selected from ammonia, a lower alkyl amine having one carbon atom to about 10 carbon atoms, a polyamine having 2 to about 12 amine nitrogen atoms and 2 to about 40 carbon atoms.

Preferably the nitrogen base for the preparation of the Mannich condensation product is an alkyl amine having one carbon atom to about 10 carbon atoms. Preferably the amine is a mono-amine, such as mono-methyl amine, mono-ethyl amine, mono-propyl amine, mono-butyl amine and mono-pentyl amine. More preferably the mono-amine is mono-methyl amine.

Metal salts of the Mannich condensation product employed in the lubricating oil composition of the present invention may be prepared by any method known to a person skilled in the art. Generally, the Mannich condensation product is prepared by reaction of the alkylphenol, a formaldehyde or an aldehyde and a nitrogen base selected from ammonia, a lower alkyl amine, a polyamine, and mixtures thereof, in the presence of a metal hydroxide and a diluent.

The preparation of Mannich condensation product is well known to persons skilled in the art. The Mannich condensation product may be prepared using an alkyl phenol, an aldehyde and an amine by any method known to a person skilled in the art. For example, the Mannich condensation product may be prepared as described in U.S. Pat. No. 5,370,805.

The metal salt of the Mannich condensation product may prepared by any well know process using a metal oxide, metal hydroxide or a metal alkoxides. The metal may be an alkali metal or an alkaline earth metal. Preferably the metal is an alkaline earth metal, and more preferably the alkaline earth metal is calcium.

Other Additives

The lubricating oil composition of the present invention may also typically contain, in addition to the detergent composition of the present invention, other additives used to impart desirable properties to the lubricating oil composition of the present invention. Thus, the lubricating oil may contain one or more of additives, such as, dispersants, anti-oxidants, viscosity index improvers, corrosion inhibitors, anti-wear agents, friction modifiers, pour point depressants and foam inhibitors.

For best overall results in terms of affording the properties desired in a conventional lubricating oil composition for a heavy duty diesel engine lubricating oil, the lubricating oil contains a compatible combination of additives of each of the above classes of additives in effective amounts as well as the detergent composition of the present invention in the amount needed to provide the desired neutralization capacity.

Low and Medium Overbased Metal Detergents

Small quantities of low or medium overbased metal detergents may optionally be employed in the lubricating oil composition of the present invention. Examples of the low and medium overbased metal detergents are low or medium overbased sulfonic acids, salicylic acids, carboxylic acids, or phenols or Mannich condensation products of phenols, aldehydes and amines. These detergents may be alkali metal detergents or alkaline metal detergents. Preferably they are alkaline earth metal detergents and more preferably they are calcium detergents. The TBN of these detergents is greater than 1 and less that 200. However, it is worth noting that a further addition of detergents, such as those described above, may contribute to the sulfur and/or sulfated ash content of the lubricating oil. These detergents are well known in the art and are commercially available.

Dispersants

The lubricating oil composition of the present invention optionally contains dispersants. Typically, the ashless dispersants are nitrogen-containing dispersants formed by reacting alkenyl succinic acid anhydride with an amine. Examples of such dispersants are alkenyl succinimides and succinamides. These dispersants can be further modified by reaction with, for example, boron or ethylene carbonate. Ester-based ashless dispersants derived from long chain hydrocarbon-substituted carboxylic acids and hydroxy compounds may also be employed. Preferred ashless dispersants are those derived from polyisobutenyl succinic anhydride. These dispersants are commercially available.

Anti-Oxidants

Anti-oxidants are used in lubricating oils for inhibition of decomposition processes that occur naturally in lubricating oils as they age or oxidize in the presence of air. These oxidation processes may cause formation of gums, lacquers and sludge resulting in an increase in acidity and viscosity. Examples of useful anti-oxidants are hindered phenols, alkylated and non-alkylated aromatic amines, alkyl or aryl phosphates, esters of thiodicarboxylic acids, salts of carbamic or di-thiophosphoric acids. Molybdenum compounds, such as amine-molybdenum complex compound and molybdenum di-thiocarbamates may also be used as anti-oxidants. However, it should be noted that the addition of molybdenum di-thiocarbamates will further contribute sulfur and sulfated ash to the lubricating oil composition Viscosity Index Improvers Viscosity index improvers are added to lubricating oil to regulate viscosity changes due to the change in temperature. Some commercially available examples of viscosity index improvers are olefin copolymers, polybutene, polymethacrylates, vinylpyrrolidone and methacrylate copolymers.

Corrosion Inhibitors

Corrosion inhibitors are included in lubricating oils to protect vulnerable metal surfaces. Such corrosion inhibitors are generally used in very small amounts in the range of from about 0.02 weight percent to about 1.0 weight percent. The corrosion inhibitor should not be one that is itself corrosive to silver and silver plated bearings, such as, metal di-thiophosphates. Examples of corrosion inhibitors that may be used are sulfurized olefin corrosion inhibitor and the co-sulfurized alkenyl ester/alpha olefin corrosion inhibitor.

In addition to the materials already described, lubricating oil composition of the present invention may also include other additives, such as pour point depressants and anti-foaming agents. The various additive materials or classes of materials herein described are well known materials and can be readily purchased commercially or prepared by known procedures or obvious modification thereof.

EXAMPLES

The detergent composition employed in the low sulfur, low sulfated ash and low phosphorus lubricating oil composition of the present invention were evaluated for their detergency performance in formulations prepared as described in Example 1 and Table I below.

Example 1

A mixture of a metal salt of an alkyl hydroxyaromatic carboxylic acid and a metal salt of an alkyl phenol was prepared as described in U.S. Pat. No. 6,162,770 and a metal salt of a Mannich condensation product was prepared as in described U.S. Pat. No. 5,370,805 for determining the detergency performance of the detergent composition employed in the low sulfur, low sulfated ash and low phosphorus lubricating oil composition of the present invention.

Comparative Formulations A and B and Test Formulation C contained an ashless dispersant, an anti-oxidant, a viscosity index improver, a medium overbased alkyl phenate, an anti-wear agent and a foam inhibitor. Base oil was used to make-up a 100 percent of each of Comparative Formulations A and B and Test Formulation C. Comparative Formulations A and B and Test Formulation C are given in more detail in Table I below.

The detergency performance of Test Formulation C containing the detergent composition of the present invention comprising Detergent (i) a mixture of a metal salt of an alkyl hydroxyaromatic carboxylic acid and a metal salt of an alkyl phenol, and Detergent (ii) a metal salt of a Mannich condensation product was compared with Comparative Formulation A containing only (i) a mixture of a metal salt of an alkyl hydroxyaromatic carboxylic acid and a metal salt of an alkyl phenol and Comparative Formulation B containing only (ii) a metal salt of a Mannich condensation product.

Comparative Formulation A contained Detergent (i) calcium salts of a mixture of two alkyl hydroxy benzene carboxylic acids, wherein the alkyl group on one alkyl hydroxy benzene carboxylic acid was a branched chain alkyl group containing 12 carbon atoms and the alkyl group on the other alkyl hydroxy benzene carboxylic acid was a linear chain alkyl group containing 20 carbon atoms to 28 carbon atoms, and calcium salts of a mixture of two alkyl phenols, where in the alkyl group on one alkyl phenol was a branched chain alkyl group containing 12 carbon atoms and the alkyl group on the other alkyl phenol was a linear chain alkyl group containing 20 carbon atoms to 28 carbon atoms. The calcium salt of alkyl hydroxybenzene carboxylic acids and the calcium salt of the alkyl phenols were present in a ratio of 3:2.

Comparative Formulation B contained Detergent (ii) a calcium salt of the Mannich condensation product of an alkyl phenol, paraformaldehyde and mono-methyl amine. The alkyl group on the alkyl phenol was a branched chain alkyl group containing 12 carbon atoms.

Test Formulation C contained the detergent composition of the present invention comprising Detergent (i) and Detergent (ii) as described for Comparative Formulations A and B above in addition to the additives described above. Thus, Test Formulation C contained the detergent mixture in Formulation A plus the detergent in Formulation B.

TABLE I

| | Formulation (weight %) | | |
|---|---|---|---|
| Component | Comparative A | Comparative B | Test C |
| Base Oil | 92.01 | 84.24 | 89.23 |
| Ashless Dispersant | 3.4 | 3.4 | 3.4 |
| Anti-oxidant | 0.5 | 0.5 | 0.5 |
| Viscosity Index | 0.28 | 0.28 | 0.28 |

TABLE I-continued

| Component | Formulation (weight %) | | |
|---|---|---|---|
| | Comparative A | Comparative B | Test C |
| Improver Medium Overbased Phenate | 0.22 | 0.22 | 0.22 |
| Anti-wear Agent | 0.36 | 0.36 | 0.36 |
| Foam Inhibitor | 0.0025 | 0.0025 | 0.0025 |
| Detergent (i)* | 3.16 | | 2.01 |
| Detergent (ii)** | | 11.00 | 4.00 |

*calcium salts of a mixture of two alkyl hydroxy benzene carboxylic acids, wherein the alkyl group on one alkyl hydroxy benzene carboxylic acid was a branched chain alkyl group containing 12 carbon atoms and the alkyl group on the other alkyl hydroxy benzene carboxylic acid was a linear chain alkyl group containing 20 carbon atoms to 28 carbon atoms, and calcium salts of a mixture of two alkyl phenols, where in the alkyl group on one alkyl phenol was a branchedchain alkyl group containing 12 carbon atoms and the alkyl group on the other alkyl phenol was a linear chain alkyl group containing 20 carbon atoms to 28 carbon atoms.
**a calcium salt of the Mannich condensation product of an alkyl phenol, paraformaldehyde and mono-methyl amine. The alkyl group on the alkyl phenol was a branched chain alkyl group containing 12 carbon atoms.

Table II below shows the amount of the sulfur, sulfated ash and phosphorus in Comparative Formulations A and B and Test Formulation C.

TABLE II

| Component | Formulation (weight %) | | |
|---|---|---|---|
| | Comparative A | Comparative B | Test C |
| Sulfur | 0.0992 | 0.1007 | 0.1002 |
| Sulfated Ash | 1.06 | 1.06 | 1.06 |
| Phosphorus | 0.0378 | 0.0378 | 0.0378 |

Example 2

Panel Coker Test

The Panel Coker Test was used to evaluate the tendency of Test Formulation C compared to Comparative Formulations A and B to form carbon deposits when in contact with a metallic surface at high temperature. Samples, 300 grams, of Comparative Formulations A and B and Test Formulation C were heated in a sump and intermittently projected by means of a rotating oil stirrer on an aluminum test plate heated at high temperature. The amount of deposit was weighed at the end of the test. The lower the number the better the detergent. Viscosity increase at 40° C. and varnish rating were also recorded.

The results of the Panel Coker Test are summarized in Table III below.

TABLE III

| Panel Coker Test | Formulation | | |
|---|---|---|---|
| | Comparative A | Comparative B | Test C |
| Deposit (mg) | 66 | 64 | 9 |
| Carbon (%) | 36 | 27 | 2 |

TABLE III-continued

| Panel Coker Test | Formulation | | |
|---|---|---|---|
| | Comparative A | Comparative B | Test C |
| Varnish (Rating) | 3.6 | 6.3 | 8.6 |
| Increase in Viscosity at 40° C. (%) | 31 | 45 | 21 |

The results obtained in the Panel Coker Test summarized above in Table III show that the Test Formulation C containing the detergent composition of the present invention comprising (i) a mixture of a metal salt of an alkyl hydroxyaromatic carboxylic acid and a metal salt of an alkyl phenol, and (ii) a metal salt of a Mannich condensation product gave better detergency performance than Comparative Formulation A containing only (i) a mixture of a metal salt of an alkyl hydroxyaromatic carboxylic acid and a metal salt of an alkyl phenol or Comparative Formulation B containing only (ii) a metal salt of a Mannich condensation product. In each of the four categories of the data collected Test Formulation C performed significantly better than either of Comparative Formulations A or B.

What is claimed:

1. A low sulfur, low sulfated ash and low phosphorus lubricating oil composition for low emission heavy duty diesel engines comprising:

(a) a major amount of an oil of lubricating viscosity;

(b) a detergent composition comprising (i) a mixture of a metal salt of an alkyl hydroxyaromatic carboxylic acid and a metal salt of an alkyl phenol, and (ii) a metal salt of a Mannich condensation product; and wherein the sulfur content is in the range of 0.0 weight percent to 0.4 weight percent, the sulfated ask content is in the range of 0.2 weight percent to 4.0 weight percent, and the phosphorus content is in the range of 0.005 weight percent to 0.06 weight percent;

wherein in (b) the ratio of (i) the mixture of a metal salt of an alkyl hydroxyaromatic carboxylic acid and a metal salt of an alkyl phenol to (ii) the metal salt of a Mannich condensation product is in the range of 80:20 weight percent to 20:80 weight percent based on the total weight of the detergent composition; and wherein in (b)(i), the ratio of the metal salt of an alkyl hydroxyaromatic carboxylic acid to the metal salt of an alkyl phenol is in the range of 80:20 weight percent to 20:80 weight percent based on the total weight of (i).

2. The lubricating oil composition of claim 1, wherein the ratio or (i) the mixture of a metal salt of an alkyl hydroxyaromatic carboxylic acid and a metal salt of an alkyl phenol to (ii) the metal salt of a Mannich condensation product is in the range of about 70:30 weight percent to about 30:70 weight percent based on the total weight of the detergent composition.

3. The lubricating oil composition of claim 2, wherein the ratio of (i) the mixture of a metal salt of an alkyl hydroxyaromatic carboxylic acid and a metal salt of an alkyl phenol to (ii) the metal salt of a Mannich condensation product is about 50:50 weight percent based on the total weight of the detergent composition.

4. The lubricating oil composition of claim 1, wherein in (b)(i) the ratio of the metal salt of an alkyl hydroxyaromatic carboxylic acid to the metal salt of an alkyl phenol is in the range of about 60:40 weight percent to about 40:60 weight percent based on the total weight of (i).

5. The lubricating oil composition of claim 4, wherein in (b)(i) the ratio of the metal salt of an alkyl hydroxyaromatic carboxylic acid and the metal salt of an alkyl phenol is about 50:50 weight percent based on the total weight of (i).

6. The lubricating oil composition of claim 1, wherein in the detergent composition (b), the alkyl group on the alkyl hydroxyaromatic carboxylic acid in (i) is a linear chain or a branched chain alkyl group or mixtures thereof.

7. The lubricating oil composition of claim 6, wherein in the detergent composition (b), the alkyl group on the alkyl hydroxyaromatic carboxylic acid in (i) is mixture of a linear chain alkyl group and a branched chain alkyl group.

8. The lubricating oil composition of claim 7, wherein the ratio of the linear chain alkyl groups to the branched chain alkyl groups on the alkyl hydroxyaromatic carboxylic acid in the mixture is in the range of about 70:30 to about 30:70 based on the total alkyl groups on the alkyl hydroxyaromatic carboxylic acid.

9. The lubricating oil composition of claim 8, wherein the ratio of the linear chain alkyl groups to the branched chain alkyl groups on the alkyl hydroxyaromatic carboxylic acid in the mixture is about 50:50 based on the total alkyl groups on the alkyl hydroxyaromatic carboxylic acid.

10. The lubricating oil composition of claim 1, wherein in the detergent composition (b), the alkyl group on the alkyl phenol in (i) is a linear chain or a branched chain alkyl group or mixtures thereof.

11. The lubricating oil composition of claim 10, wherein in the detergent composition (b), the alkyl group on the alkyl phenol in (i) is a mixture of a linear chain alkyl group and a branched chain alkyl group.

12. The lubricating oil composition of claim 11, wherein the ratio of the linear chain alkyl groups to the branched chain alkyl groups on the alkyl phenol in the mixture is in the range of about 70:30 to about 30:70 based on the total alkyl groups on the alkyl phenol.

13. The lubricating oil composition of claim 12, wherein the ratio of the linear chain alkyl groups to the branched chain alkyl group on the alkyl phenol in the mixture is about 50:50 based on the total alkyl groups on the alkyl phenol.

14. The lubricating oil composition of claim 7, wherein in the detergent composition (b), the branched chain alkyl group on the alkyl hydroxyaromatic carboxylic acid in (i) has from about 4 carbon atoms to about 60 carbon atoms.

15. The lubricating oil composition of claim 14, wherein the branched chain alkyl group on the alkyl hydroxyaromatic carboxylic acid has from about 6 carbon atoms to about 40 carbon atoms.

16. The lubricating oil composition of claim 15, wherein the branched chain alkyl group on the alkyl hydroxyaromatic carboxylic acid has from about 8 carbon atoms to about 20 carbon atoms.

17. The lubricating oil composition of claim 7, wherein in the detergent composition (b), the linear chain alkyl group on the alkyl hydroxyaromatic carboxylic acid in (i) has from about 4 carbon atoms to about 60 carbon atoms.

18. The lubricating oil composition of claim 17, wherein the linear chain alkyl group on the alkyl hydroxyaromatic carboxylic acid has from about 12 carbon atoms to about 40 carbon atoms.

19. The lubricating oil composition of claim 18, wherein the linear chain alkyl group on the alkyl hydroxyaromatic carboxylic acid has from about 20 carbon atoms to about 30 carbon atoms.

20. The lubricating oil composition of claim 1, wherein in the detergent composition (b), the branched chain alkyl group on the alkyl phenol in (i) has from about 4 carbon atoms to about 60 carbon atoms.

21. The lubricating oil composition of claim 10, wherein the branched chain alkyl group on the alkyl phenol has from about 6 carbon atoms to about 40 carbon atoms.

22. The lubricating oil composition of claim 21, wherein the branched chain alkyl group on the alkyl phenol has from about 8 carbon atoms to about 20 carbon atoms.

23. The lubricating oil composition of claim 10, wherein in the detergent composition (b), the linear chain alkyl group on the alkyl phenol in (i) has from about 4 carbon atoms to about 60 carbon atoms.

24. The lubricating oil composition of claim 23, wherein the linear chain alkyl group on the alkyl phenol has from about 12 carbon atoms to about 40 carbon atoms.

25. The lubricating oil composition of claim 24, wherein the linear chain alkyl group on the alkyl phenol has from about 20 carbon atoms to about 30 carbon atoms.

26. The lubricating oil composition of claim 1, wherein in the detergent composition (b), the Mannich condensation product in (ii) is a condensation product of a formaldehyde or an aldehyde having one carbon atom to about 20 carbon atoms, a nitrogen base selected from ammonia, a lower alkyl amine, polyamine and mixtures thereof, and an alkyl phenol.

27. The lubricating oil composition of claim 26, wherein the lower alkyl amine has from one carbon atom to about 10 carbon atoms and the polyamine has from 2 amine nitrogen atoms to about 12 amine nitrogen atoms and 2 carbon atoms to about 40 carbon atoms.

28. The lubricating oil composition of claim 26, wherein in the detergent composition (b), the Mannich condensation product in (ii) the alkyl group on the alkyl phenol is a linear chain or a branched chain alkyl group or mixtures thereof.

29. The lubricating oil composition of claim 28, wherein the alkyl group on the alkyl phenol of the Mannich condensation product is a branched chain alkyl group.

30. The lubricating oil composition of claim 29, wherein in the detergent composition (b), the Mannich condensation product in (ii) the branched chain alkyl group on the alkyl phenol has from about 4 carbon atoms to about 60 carbon atoms.

31. The lubricating oil composition of claim 30, wherein the branched chain alkyl group on the alkyl phenol of the Mannich condensation product has from about 6 carbon atoms to about 40 carbon atoms.

32. The lubricating oil composition of claim 31, wherein the branched chain alkyl group on the alkyl phenol of the Mannich condensation product has from about 8 carbon atoms to about 20 carbon atoms.

33. The lubricating oil composition of claim 28, wherein in the detergent composition (b), the Mannich condensation product in (ii) the linear chain alkyl group on the alkyl phenol has from about 4 carbon atoms to about 60 carbon atoms.

34. The lubricating oil composition of claim 33, wherein the linear chain alkyl group on the alkyl phenol of the Mannich condensation product has from about 12 carbon atoms to about 40 carbon atoms.

35. The lubricating oil composition of claim 34, wherein the linear chain alkyl group on the alkyl phenol of the Mannich condensation product has from about 20 carbon atoms to about 30 carbon atoms.

36. The lubricating oil composition of claim 1, wherein in (i) the alkyl hydroxyaromatic carboxylic acid is an alkyl hydroxybenzene carboxylic acid, wherein the alkyl group is a 50:50 mixture of a branched chain $C_{12}$ alkyl group and a linear chain $C_{20}$ to $C_{30}$ alkyl group.

37. The lubricating oil composition of claim 1, wherein in (i) the alkyl group on the alkyl phenol is a 50:50 mixture of a branched chain $C_{12}$ alkyl group and a linear chain $C_{20}$ to $C_{30}$ alkyl group.

38. The lubricating oil composition of claim 26, wherein in (ii) the Mannich condensation product is a condensation product of an alkyl phenol, wherein the alkyl group is a branched chain $C_{12}$ alkyl group, paraformaldehyde and mono-methyl amine.

39. The lubricating oil composition of claim 1, wherein the metal salt in each of the alkyl hydroxyaromatic carboxylic acid, the alkyl phenol and the Mannich condensation product is independently an alkali metal or an alkaline earth metal.

40. The lubricating oil composition of claim 39, wherein the metal salt in each of the alkyl hydroxyaromatic carboxylic acid, the alkyl phenol and the Mannich condensation product is an alkaline earth metal salt.

41. The lubricating oil composition of claim 40, wherein the alkaline earth metal is calcium.

42. The lubricating oil composition of claim 1, wherein the sulfur content is in the range of about 0.05 weight percent to about 0.3 weight percent based on the total weight of the lubricating oil.

43. The lubricating oil composition of claim 42, wherein the sulfur content is in the range of about 0.1 weight percent to about 0.2 weight percent based on the total weight of the lubricating oil.

44. The lubricating oil composition of claim 1, wherein the sulfated ash content is in the range of about 0.5 weight percent to about 2.0 weight percent based on the total weight of the lubricating oil.

45. The lubricating oil composition of claim 44, wherein the sulfated ash content is in the range of about 0.75 weight percent to about 1.2 weight percent based on the total weight of the lubricating oil.

46. The lubricating oil composition of claim 1, wherein the phosphorus content is in the range of about 0.015 weight percent to about 0.05 weight percent based on the total weight of the lubricating oil.

47. The lubricating oil composition of claim 46, wherein the phosphorus content is in the range of about 0.03 weight percent to about 0.04 weight percent based on the total weight of the lubricating oil.

48. A low sulfur, low sulfated ash and low phosphorus lubricating oil concentrate for low emission heavy duty diesel engines comprising:

(a) a major amount of an oil of lubricating viscosity;

(b) a detergent composition comprising (i) a mixture of a metal salt of an alkyl hydroxyaromatic carboxylic acid and a metal salt of an alkyl phenol, and (ii) a metal salt of a Mannich condensation product; and wherein the sulfur content is in the range of 0.0 weight percent to 0.4 weight percent, the sulfated ash content is in the range of 0.2 weight percent to 4.0 weight percent, and the phosphorus content is in the range of 0.005 weight percent to 0.06 weight percent;

wherein in (b) the ratio of (i) the mixture of a metal salt of an alkyl hydroxyaromatic carboxylic acid and a metal salt of an alkyl phenol to (ii) the metal salt of a Mannich condensation product is in the range of 80:20 weight percent to 20:80 weight percent based on the total weight of the detergent composition; and wherein in (b)(i), the ratio of the metal salt of an alkyl hydroxyaromatic carboxylic acid to the metal salt of an alkyl phenol is in the range of 80:20 weight percent to 20:80 weight percent based on the total weight of (i).

49. A method for lubricating low emission heavy duty diesel engines using a low sulfur, low sulfated ash and low phosphorus lubricating oil composition comprising:

(a) a major amount of an oil of lubricating viscosity;

(b) a detergent composition comprising (i) a mixture of a metal salt of an alkyl hydroxyaromatic carboxylic acid and a metal salt of an alkyl phenol, and (ii) a metal salt of a Mannich condensation product; and wherein the sulfur content is in the range of 0.0 weight percent to 0.4 weight percent, the sulfated ash content is in the range of 0.2 weight percent to 4.0 weight percent, and the phosphorus content is in the range of 0.005 weight percent to 0.06 weight percent;

wherein in (b) the ratio of (i) the mixture of a metal salt of an alkyl hydroxyaromatic carboxylic acid and a metal salt of an alkyl phenol to (ii) the metal salt of a Mannich condensation product is in the range of 80:20 weight percent to 20:80 weight percent based on the total weight of the detergent composition; and wherein in (b)(i), the ratio of the metal salt of an alkyl hydroxyaromatic carboxylic acid to the metal salt of an alkyl phenol is in the range of 80:20 weight percent to 20:80 weight percent based on the total weight of (i).

* * * * *